US009899166B1

(12) United States Patent
Shychuck et al.

(10) Patent No.: US 9,899,166 B1
(45) Date of Patent: Feb. 20, 2018

(54) HIGH VOLTAGE FOLDING DISCONNECT SWITCH WITH LOCKING DEVICE

(71) Applicant: CLEAVELAND/PRICE INC., Trafford, PA (US)

(72) Inventors: James R. Shychuck, Greensburg, PA (US); Peter M. Kowalik, Trafford, PA (US)

(73) Assignee: CLEAVELAND /PRICE INC., Trafford, PA (US)

( * ) Notice: Subject to any disclaimer, the term of this patent is extended or adjusted under 35 U.S.C. 154(b) by 0 days.

(21) Appl. No.: 15/139,412

(22) Filed: Apr. 27, 2016

Related U.S. Application Data

(60) Provisional application No. 62/187,876, filed on Jul. 2, 2015.

(51) Int. Cl.
*H01H 31/04* (2006.01)
*H01H 31/02* (2006.01)

(52) U.S. Cl.
CPC ..... *H01H 31/04* (2013.01); *H01H 31/026* (2013.01)

(58) Field of Classification Search
CPC ..... H01H 31/04; H01H 31/026; H01H 31/02; H01H 31/30
USPC ..... 200/48 R, 48 A
See application file for complete search history.

(56) References Cited

U.S. PATENT DOCUMENTS 4,126,773 A * 11/1978 Bernatt ..... H01H 31/02 218/12
5,072,082 A * 12/1991 Kowalik ..... H01H 1/54 218/23
5,821,486 A * 10/1998 Paw ..... H01H 31/28 200/48 A

OTHER PUBLICATIONS

The 1st and 6th page of Cleaveland/Price Inc. Bulletin AP-B-03 entitled "Switches and Motor Operators".

* cited by examiner

*Primary Examiner* — Edwin A. Leon
*Assistant Examiner* — Iman Malakooti
(74) *Attorney, Agent, or Firm* — Ronald S. Lombard

(57) ABSTRACT

A high voltage folding disconnect switch including a folding switch blade that folds as it opens or closes and which is divided into a fixed blade portion attached to a rotating insulator and a folded blade portion having an electric contact surface engaging a break jaw contact surface. A trigger lever-locking bar is mounted to the fixed blade portion. The trigger lever-locking bar includes a trigger finger for contacting a trigger surface mounted on a stationary insulator. The trigger lever-locking bar has a cam slot for interaction with a cam follower pin that locks the movement of the folding blade so that premature straightening of the blade is prevented until any ice build-up on the switch has been alleviated.

7 Claims, 6 Drawing Sheets

HIGH VOLTAGE FOLDING DISCONNECT SWITCH WITH LOCKING DEVICE

CROSS-REFERENCE TO RELATED APPLICATION

This application claims the benefit of U.S. Provisional Application No. 62/187,876 filed Jul. 2, 2015, which is incorporated herein by reference in its entirety.

BACKGROUND OF THE INVENTION

The present invention relates generally to a disconnect switch for high voltage electrical applications and, more particularly, to a folding disconnect switch having a switch blade that folds as it opens and is folded as it begins to close to lower the force necessary to disengage or re-engage the contacts of the switch. One example of such a switch is a folding side break electric disconnect switch such as manufactured and sold by Cleaveland/Price, Inc. of Trafford, Pa., the present assignee, as Model RL-C, a copper side break switch rated at 115 kV, 1200 A. The folding of the switch blade also aids in breaking ice on outdoor disconnect switches as the switch opens or closes. The typical folding blade has two switch blade portions, i.e., a fixed blade portion and a folding blade portion, that are operatively joined by a current carrying joint that is often spring biased to keep the blade in the folded state. The spring at the joint causes the switch blade to fold as it opens which sets up the blade to be in a folded condition prior to re-engaging, for example, reengaging with a notch in the break jaw contact as the switch closes.

In electric utility power systems, high voltage disconnect switches are employed to isolate substation conductors and transmission lines and high voltage electrical apparatus to permit the inspection or repair of such apparatus or redirect power or other reasons. When a switch is called on to close and the break jaw and/or blade is covered with a build-up of ice, the blade must be closed rapidly to impart a chopping action to break through the ice. In the case where the switch has no ice shield or is mounted in an orientation where an ice shield cannot be used to keep the switch contacts free of ice, the conventional folding blade will often malfunction by prematurely straightening, since the joint spring has limited force to keep the blade folded, often resulting in misalignment, for example, of a break jaw contact pin on the blade tip with a notch within the switch jaw contacts. This situation requires opening and refolding the switch blade using a hot stick and attempting to close the switch again, possibly repeatedly.

It is therefore an object of the present invention to provide a high voltage folding disconnect switch, such as a side break electric disconnect switch, with a simple reliable apparatus for preventing premature straightening of the blade during closing; to aid the switch in breaking ice build-up on the switch blade and break jaw contacts during switch opening or closing; and, to cause proper alignment of the folding switch blade with the break jaw contact during closing, for example, by proper alignment of the break jaw contact pin on the blade tip with the notch within the switch jaw contacts.

SUMMARY OF THE INVENTION

The present invention solves the malfunction problem due to ice build-up on the break jaw contacts and blade of a folding high voltage disconnect switch by locking the switch blade from straightening until most of any ice build-up has been chopped or broken away and the folding switch blade is in proper alignment with the break jaw contact, so that, for example, the break jaw contact pin on the blade is in position to enter the break jaw notch within the break jaw contacts during closing of the switch. At this point in the closing stroke of the switch, a trigger mechanism will release a lock which allows the blade to straighten and the blade pin to enter the notch in the break jaw and the switch contacts to be fully made closed electrically.

Such a folding high voltage disconnect switch is mounted at one end to a rotating insulator. To open or close the switch the rotating insulator is caused to rotate, for example, counter clockwise, causing the switch blade to fold at the current carrying joint. The switch blade, as mentioned, is divided into a fixed blade portion and a folding blade portion connected by a joint that enables folding of the switch blade. Typically mounted to the distal end of the folding blade portion is a blade pin or break jaw contact pin. A joint spring is provided and is attached at one end to a pin on the fixed blade portion and at the other end to a pin on the folding blade portion. The joint spring is known from the prior art, for example, side break switch, and keeps the blade folded as the switch blade opens and as the switch begins to close, the break jaw contact pin re-enters the notch in the break jaw contact as the folding blade straightens.

The present invention provides an additional return spring, i.e., a second spring, attached at one end in predetermined position to the fixed blade portion and the other end to a locking device. The fixed blade portion is fixed to the rotating insulator. A trigger lever-locking bar, i.e., the locking device, is mounted near its proximal end to the fixed blade portion, such that the trigger lever-locking bar is pivotal near its proximal end. The second return spring is attached at its other end to the proximal end of the trigger lever-locking bar. At the distal end of the trigger lever-locking bar is a trigger finger which contacts an opposing permanently mounted trigger surface which is attached to a plate at the top of a stationary insulator which the break jaw is also mounted to. Near the distal end of the trigger lever-locking bar, adjacent the trigger finger, is a cam slot that accommodates and cooperates with a cam follower pin that is attached to the folding blade portion in predetermined position. At the distal end of the folding blade portion is the break jaw contact pin that engages the notch in the break jaw upon the switch closing. When the switch is fully closed, the contact pin within the notch keeps the switch blade from opening due to short circuit magnetic forces.

The cam slot has two sections. The cam follower pin, when the switch blade is in the open position, that is, when the switch blade is folded, rides in the first section of the cam slot and the trigger lever-locking bar prevents the blade from straightening. As the switch blade is closed, the trigger finger contacts the trigger surface, which after a predetermined distance of contact between the trigger finger and the trigger surface, the cam follower pin is caused to move into the second section of the cam slot, whereupon the switch blade is unlocked and allows the blade to fully straighten. Upon the switch blade straightening, the break jaw contact pin continues to break any ice build-up at the break jaw, and enters the notch within the break jaw contacts to fully electrically close the switch. Thus, any malfunction by premature straightening of the switch blade when contacting ice build-up on the switch parts and the resultant misalignment of the of the break jaw contact pin with the notch in the breakjaw is prevented by the trigger-lever locking bar. By locking the folding blade from premature straightening any ice build-up may be chopped or broken away and the blade and contact pin may be properly aligned to enter the notch, thus, the malfunction problem of the prior art switch is eliminated with the present invention.

These and other aspects of the present invention will be further understood from the entirety of the description, drawings and claims.

BRIEF DESCRIPTION OF THE DRAWINGS

For a better understanding of the invention reference may be made to the accompanying drawings exemplary of the invention, in which.

DETAILED DESCRIPTION OF THE INVENTION

Figure 1A:
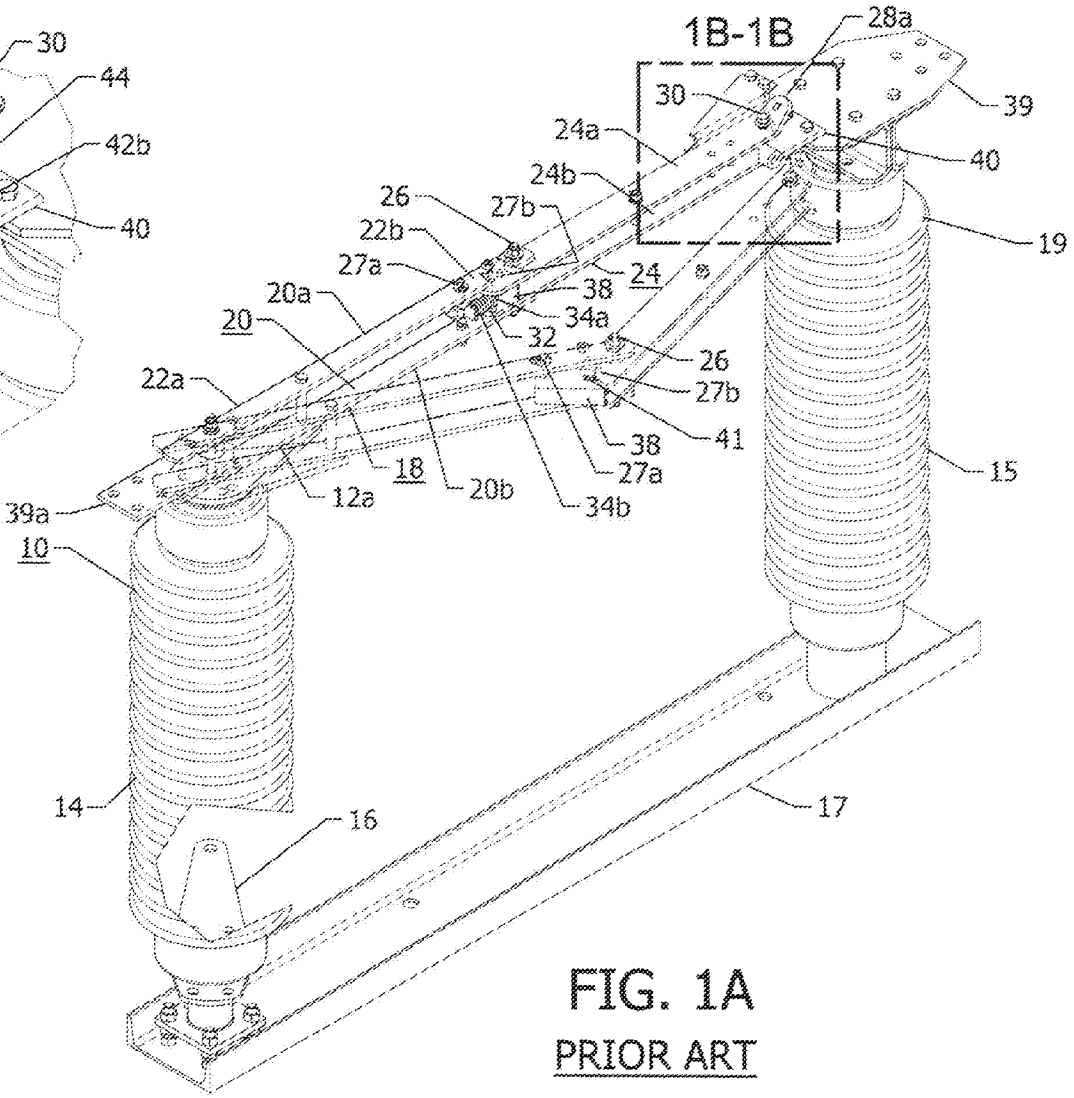
FIG. 1A PRIOR ART
FIG. 1A is a perspective view of a prior art folding side break disconnect switch in the full closed position, and also shown in dotted line in the partially open position.
Figure 1B:
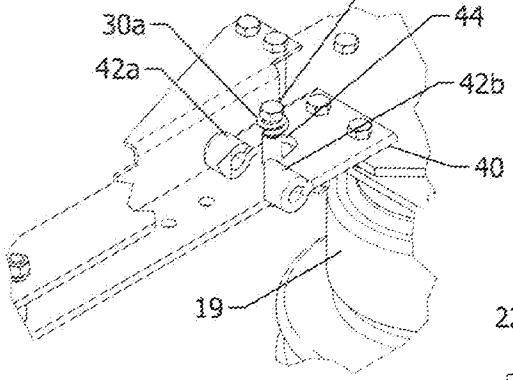
FIG. 1B is an enlarged perspective view of area 1B-1B of FIG. 1A with the upper blade of the folding blade portion cut away to show the break jaw.

With reference to FIG. 1A, there is shown a prior art folding high voltage electric disconnect switch 10 in a so-called side break configuration. The complete folding disconnect switch 10 includes a switch blade structure 18 that is mounted at one end 12*a* to rotating insulator 14 that has a lever 16 mounted thereto to permit turning of the insulator 14 to cause opening and closing of the switch 10. At the top of rotating insulator 14 is electric terminal 39*a* which has an electric pivot contact to allow rotation of the fixed blade portion 20 while the terminal 39*a* is stationary. The switch 10 includes a switch blade structure 18 divided into the fixed blade portion 20 including upper fixed blade 20*a* and lower fixed blade 20*b* and a folding blade portion 24 including an upper folding blade 24*a* and a lower folding blade 24*b*. The fixed blade portion 20 is attached at one end 22*a* to the rotating insulator 14 such that rotation of the insulator via lever 16 also rotates the fixed blade portion 20, as well as the folding blade portion 24. The other end 22*b* of the fixed blade portion 20 is rotatably attached to the folding blade portion 24 via an electrically conductive joining with pin 26 that permits folding of the switch blade structure 18. Mounted to the distal end 28*a* of the folding blade portion 24 is a break jaw contact pin 30 that has an electric contact spring 30*a* that provides pressure to make electric contact between the distal end 28*a* of the folding blade portion 24, i.e., the ends of upper folding blade 24*a* and lower folding blade 24*b*, and the break jaw contacts 42*a* and 42*b*, as shown in FIGS. 1A and 1B. A joint return spring 32 within housing 38 is attached at the moving end 34*a* thereof to joint spring pin 27*b* which moves within housing 38 at slot 41, the other stationary end 34*b* of the joint spring 32 is attached to joint spring pin 27*a*. The joint spring 32 applies a force between pins 27*a* and 27*b* to bias the folding blade portion 24 in the folded position—pivoting about electric joint pin 26. The joint spring 32 as mentioned keeps the blade folded as the blade opens and as the blade begins to close, but has only enough bias force to keep the blade folded but not enough force to prevent premature straightening during ice breaking. The joint return spring 32 within housing 38 is typically housed in a spring box 38 which keeps ice from binding the moving spring. The switch 10 also includes a stationary insulator 15 which is mounted to a base 17 opposite the rotating insulator 14. Attached at the top 19 of the stationary insulator 14 is a break jaw electric terminal 39 which has electrically attached thereto the break jaw 40. The break jaw 40 includes a pair of oppositely disposed break jaw contacts 42*a*, 42*b*, better shown in FIG. 1B. Between the two break jaw contacts 42*a*, 42*b* is notch 44. The notch 44 as mentioned is for receiving the break jaw contact pin 30 upon the closing of switch 10. The switch 10 described thus far as shown in FIGS. 1A and 1B is the prior art switch.

Figures 2A, 2B:
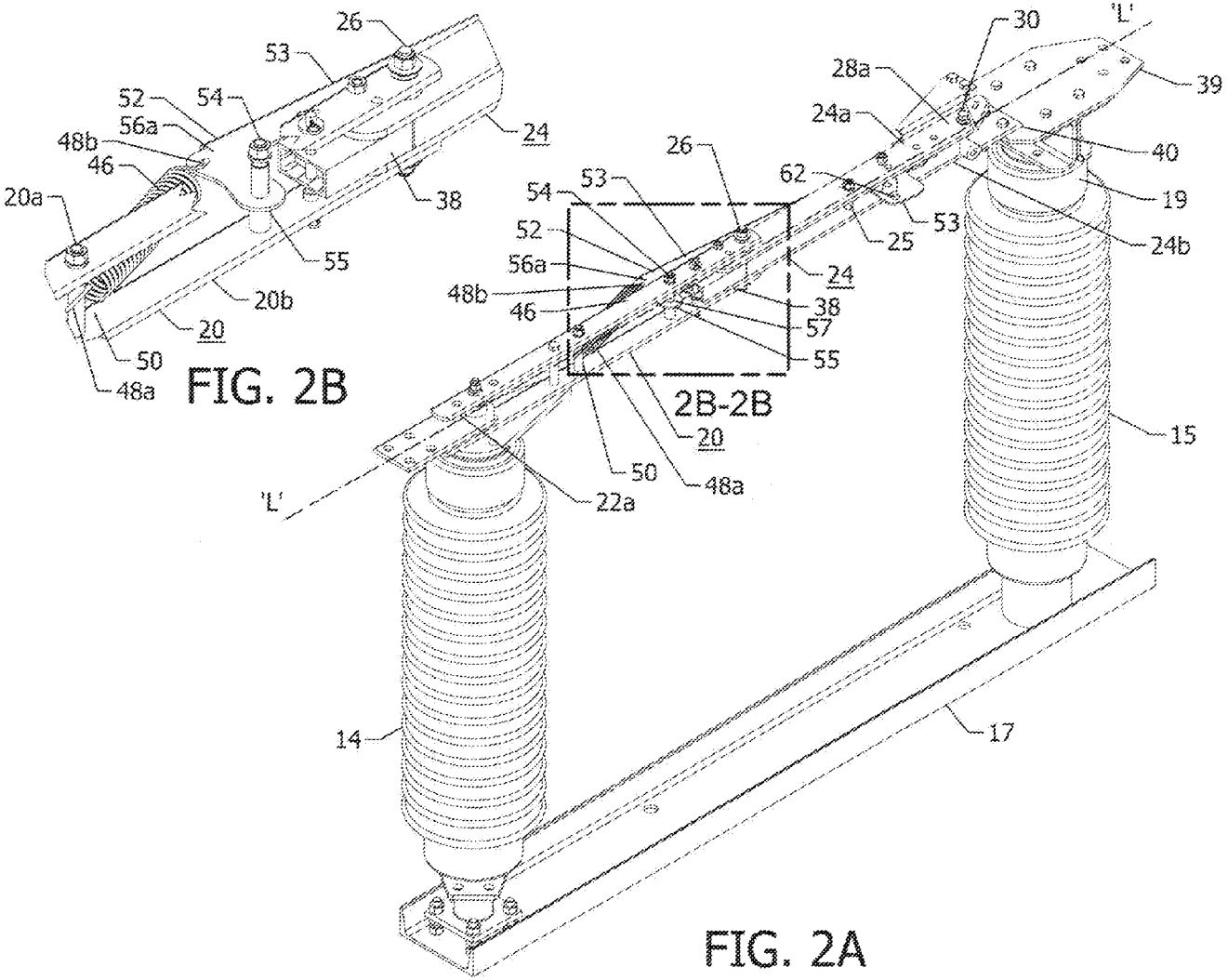
FIG. 2A is a perspective view of a folding side break disconnect switch of the present invention in the full closed position.
FIG. 2B is an enlarged perspective view of area 2B-2B of FIG. 2A with the upper blade of the fixed blade portion partially cut away to show the proximal end of the trigger lever-locking bar.
Figure 3:
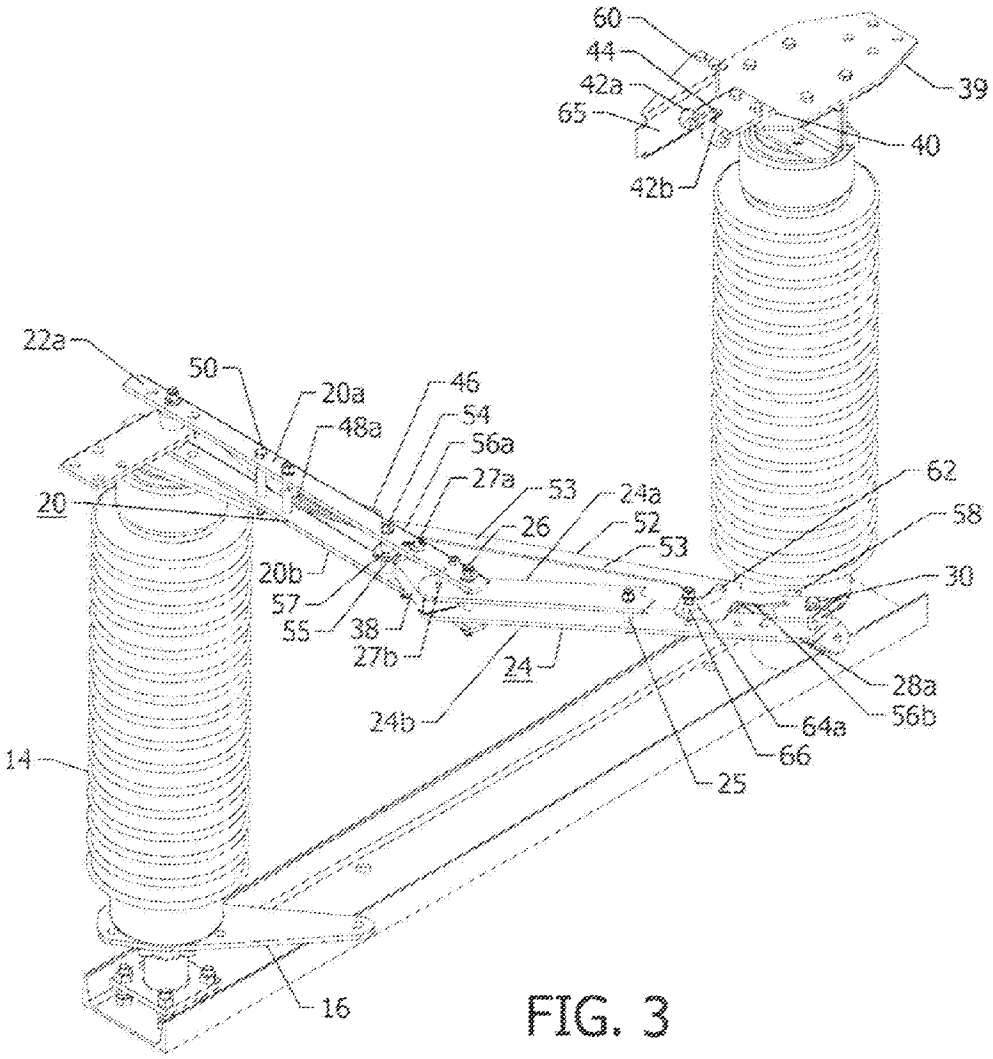
FIG. 3 is a perspective view of a folding side break disconnect switch of the present invention in the full open position with the upper blade of the folding blade portion cut away to show the cam slot of the locking bar.

The present invention utilizes the prior art folding disconnect switch 10 as described thus far and makes improvements including the following. With reference to FIGS. 2A, 2B and 3, a second return spring 46 is attached at one end 48*a* to return spring pin 50 which is attached to fixed blade portion 20 and the other end 48*b* of the second return spring 46 is attached to a trigger lever-locking bar 52 at its proximal end 56*a*. The trigger lever-locking bar 52 has a central elongated offset section 53 that is offset from the center line 'L' of the switch blade 18 in the closed position. The offset section 53 is offset structured to avoid interfering with a trigger lever pivot pin 54 that extends transversely to the center line 'L' between opposite upper and lower fixed blade pairs 20*a*, 20*b* of the fixed blade portion 20 as better shown in FIG. 2B. Also, the offset section 53 avoids interfering with electric joint pin 26, joint return spring 32, housing 38, joint spring pins 27*a*, 27*b* and folding blade portion pin 25. The central elongated offset section 53 of the trigger lever-locking bar 52 is offset a distance such as, as two inches, from the center line 'L' of the switch blade structure 18. The trigger lever-locking bar 52 has a trigger lever pivot pin engagement portion 55 at the proximal end 56*a* thereof. The trigger lever pivot pin engagement portion 55 having a pivot point hole 57 therethrough aligned with the center line 'L' of the switch blade 18 in the closed position, as shown in FIG. 2A. The trigger lever pivot pin 54 engages the pivot point hole 57 to secure the trigger lever-locking bar 52 so that it is pivotally mounted near its proximal end 56*a* and attached to fixed blade portion 20.

Figure 6A:
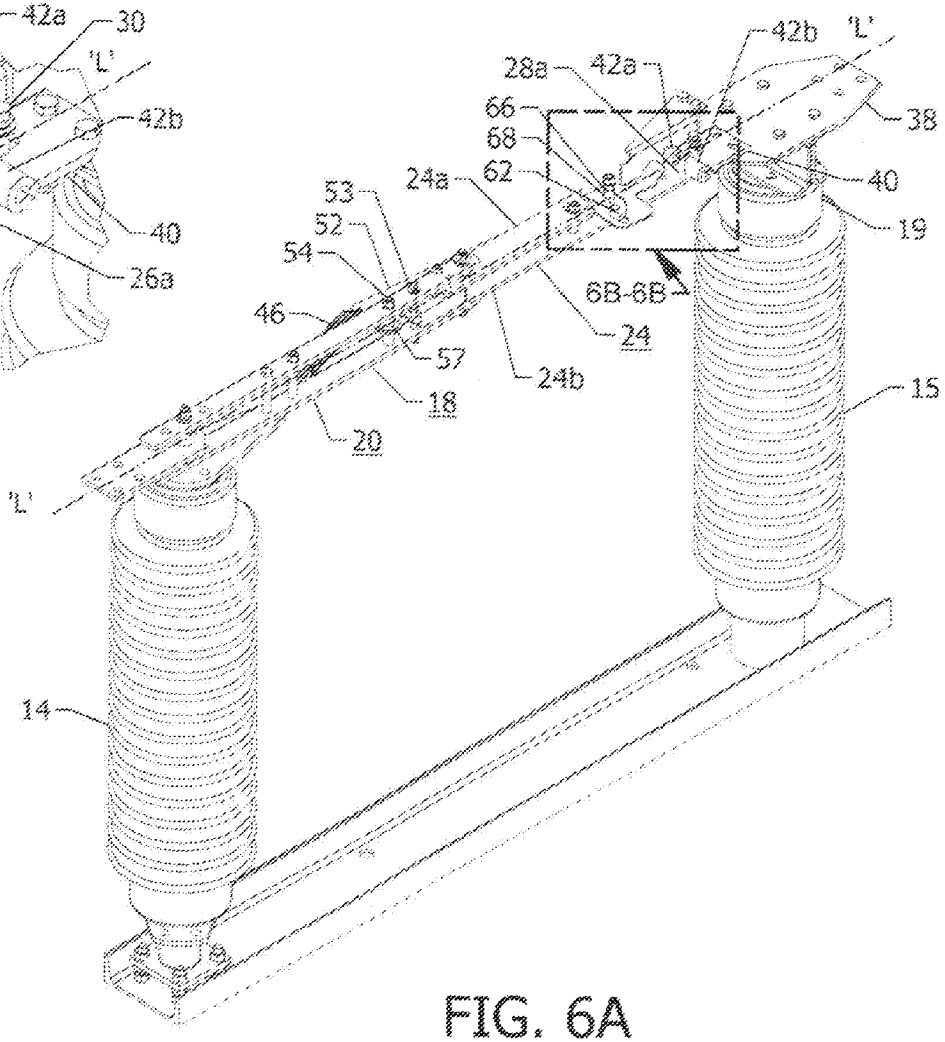
FIG. 6A is a perspective view of the folding side break disconnect switch of the present invention where the trigger finger has moved further along the trigger surface, then as shown in FIG. 5A, and the cam follower pin is now at the far end of the second section of the cam slot and the blade has fully straightened and the break jaw contact pin has fully entered the notch within the break jaw contacts; and, FIG. 6B is an enlarged perspective view taken along the line 6B-6B of FIG. 6A.
Figure 6B:
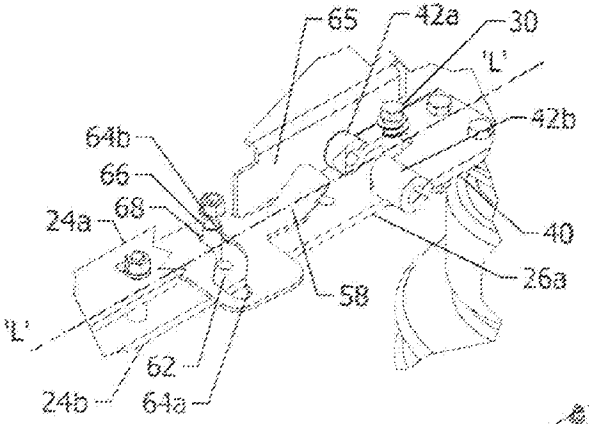

FIG. 3 shows at the distal end 56*b* of the trigger lever-locking bar 52 operatively positioned is the trigger finger 58. Also mounted to the break jaw terminal 39 is a trigger finger contact member 60 having a trigger surface 65. The trigger finger 58 during closing of the switch blade 18 contacts the trigger surface 65 as hereinafter described in further detail. The trigger lever-locking bar 52 adjacent to the trigger finger 58 includes a cam slot 62 operatively positioned therethrough. The cam slot 62 as can be seen also, for example, in FIGS. 4A and 4B, has a somewhat reverse "S" shape. The cam slot 62 as mentioned has a first section 64*a* and a second section 64*b* more clearly shown in FIG. 4B. The first section 64*a*, when the switch blade 18 is in the closed position as shown in FIGS. 6A and 6B, is offset from the center line 'L' and is further away from the trigger finger 58 then the second section 64*b*. The second section 64*b*, when the switch blade 18 is in the closed position, is in substantial alignment with the center line 'L' of the switch blade 18 and is closer to the trigger finger 58 then the first section 64*a*. The cam follower pin 66 is attached to upper and lower folding blade pairs 24*a*, 24*b* of the folding blade portion 24 as shown in FIG. 2, FIG. 3, FIGS. 6A and 6B, and rides in the cam slot 62 of the trigger lever-locking bar 52. As mentioned the cam slot 62 cooperates with the cam follower pin 66.

Figure 4A:
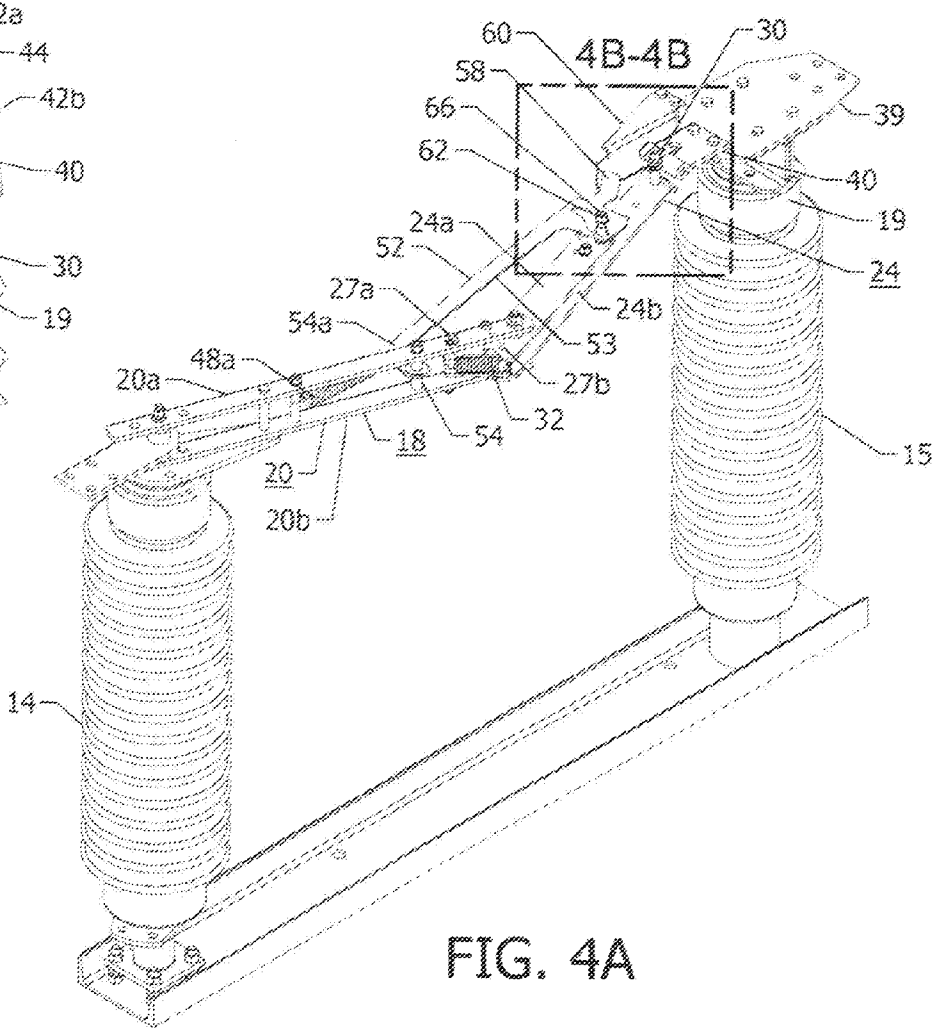
FIG. 4A is a perspective view of a folding side break disconnect switch of the present invention where the trigger finger is just beginning to contact the trigger surface upon closing prior to full straightening of the blade while the cam follower pin is still in the first section of the cam slot, which is the locking section of the slot.
Figure 4B:
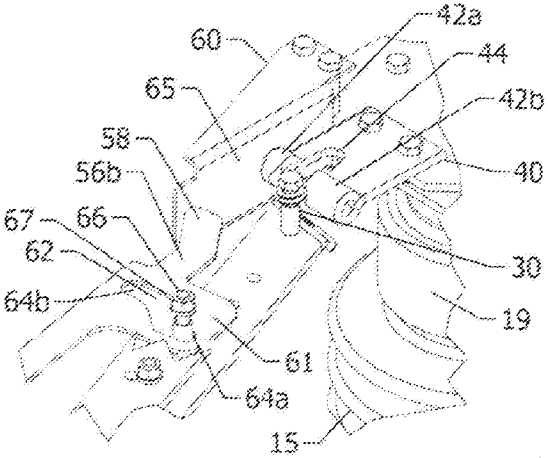
FIG. 4B is an enlarged perspective view taken along the line 4B-4B of FIG. 4A, also with the upper blade of the folding blade portion cut away to show part details.
Figure 5A:
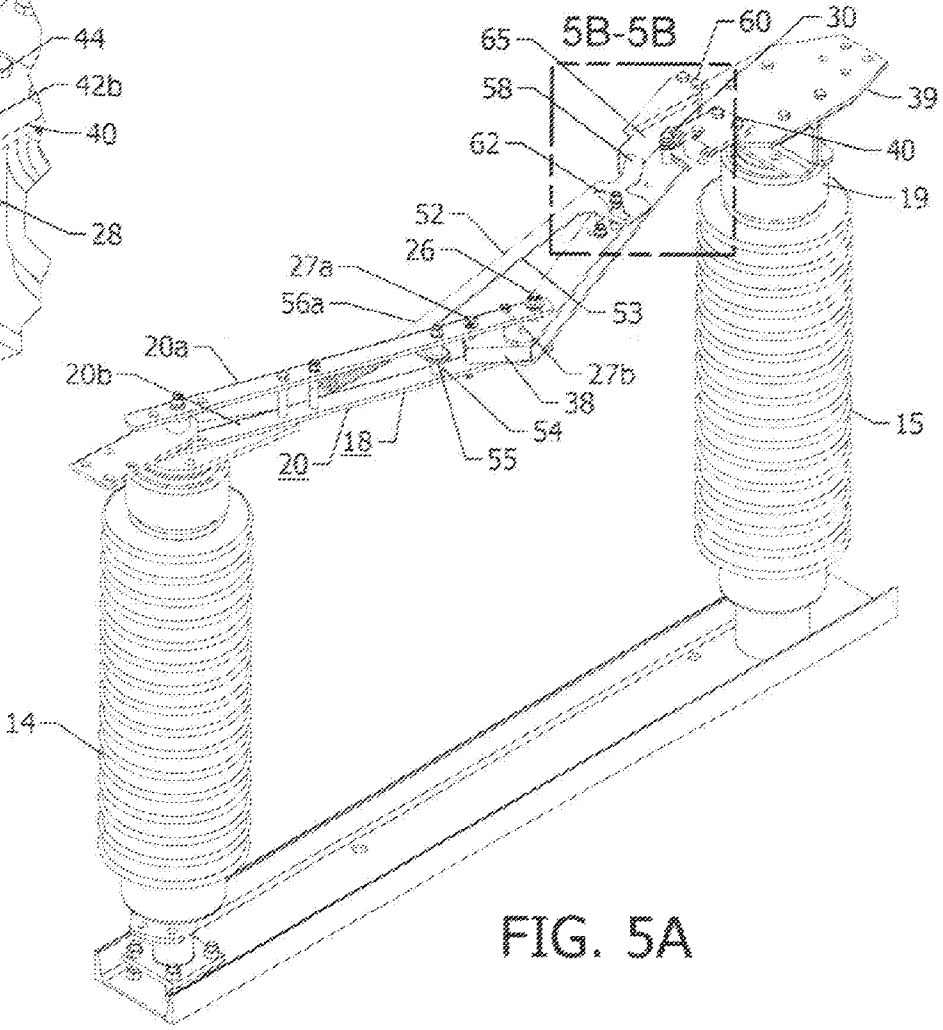
FIG. 5A is a perspective view of the folding side break disconnect switch of the present invention where the trigger finger has moved farther along the trigger surface than as shown in FIG. 4A, and the cam follower pin is just entering the second section of the cam slot to initiate unlocking of the folding blade.
Figure 5B:
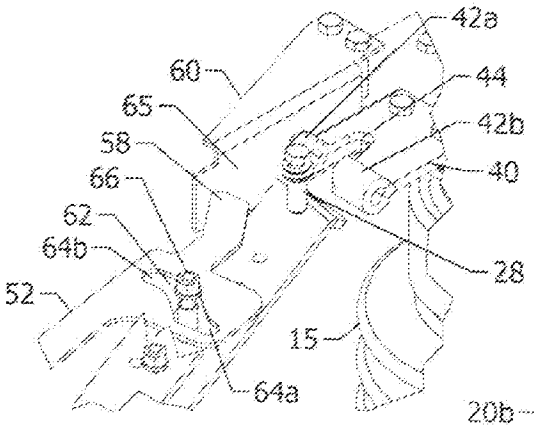
FIG. 5B is an enlarged perspective view taken along the line 5B-5B of FIG. 5A, with the upper blade of the folding blade portion cut away to show part details.

The cam follower pin 66, when the switch 10 of the present invention is in the open position, rides in the first section 64*a* of the reverse "S" shaped cam slot 62 and the trigger lever-locking bar, as shown in FIG. 3, prevents the blade 18 from straightening. As the switch blade 18 is closed, the trigger finger 58 now begins to contact the trigger surface 65, as shown in FIGS. 4A and 4B. The cam follower pin 66, as shown in FIGS. 5A and 5B, at the same time begins to leave the first section 64*a*, i.e., at the middle part of the reverse "S" of the cam slot 62, and enters the second section 64*b* of the cam slot 62 allowing the blade 18 to straighten by permitting the cam follower pin 66 to become aligned with the center line 'L' of the straightened switch blade 18. As the trigger finger 58 slides further along the trigger surface 65 the pin 66 moves along the cam surface 67 of the cam slot 62 as shown in FIG. 4B. When the cam follower pin 66 is in the 64*a* section of the cam slot 62, i.e., the first section of the slot, the folding blade 18 remains folded and is locked from straightening and when pin 66 is located in the 64*b* section of the cam slot 62, i.e., the second section of the slot 62, the folding blade 18 is unlocked as the cam follower pin 66 moves along the cam surface 67 and is allowed to straighten. The trigger surface 65 for the side break switch 10, as shown in the drawings, may be preferably vertical and flat. As the trigger finger 58 is caused, by the closing of the switch blade 18, to move further along the trigger surface 65, as shown in FIGS. 6A and 6B, the cam follower pin 66 reaches the second section 64*b* of the slot 62 in substantial alignment with center line 'L' and the switch blade may be fully straightened. At that point, the break jaw contact pin 30 is caused to be in full electrical closed position within the notch 44 within the break jaw contacts 42*a*, 42*b*. Of course, when the switch 10 is opened the opposite procedure takes place.

The present locking mechanism as described can also be applied, for example, to folding ground switch blades, or any type of switch with a folding blade.

Of course variations from the foregoing embodiments are possible without departing from the scope of the invention. Other switch types such as ground blades and double break switch with folding blades can also utilize the present invention of this locking device to improve performance during ice breaking.

What is claimed is:

1. A high voltage folding disconnect switch including a folding switch blade divided into a fixed blade portion and a folding blade portion, the fixed blade portion operatively rotatably connected to the folding blade portion by an electrically conductive joint, one end of the folding switch blade mounted to a rotating insulator, a joint return spring operatively attached at one end thereof to the fixed blade portion and the other end of the joint return spring operatively attached to the folding blade portion to bias the folding switch blade in a folded position, a break jaw contact operatively attached to a stationary insulator, the folding switch blade for operative electrical engagement with the break jaw contact upon the closing of the high voltage folding disconnect switch, the improvement which comprises:

means for mechanically locking the folding switch blade in a folded condition until contact touch with the break jaw contact and for mechanically unlocking the folding switch blade to permit straightening of the folded switch blade as the folding switch blade engages the break jaw contact;

wherein the means for mechanically locking the folding switch blade in a folded condition until contact touch with the break jaw contact and for mechanically unlocking the folding switch blade to permit straightening of the folded switch blade as the folding switch blade engages the break jaw contact comprises:

a locking device which prevents the folding switch blade from straightening until the lock is released upon switch closing at contact touch with the break jaw contact, said locking device comprising a locking bar in pivotal mounted relationship proximate a proximal end thereof with the fixed blade portion, a trigger on the locking bar operatively disposed at a distal end of the locking bar;

a second return spring for the locking device operatively attached to the fixed blade portion;

a trigger engagement member in operative attachment with the stationary insulator, the trigger engagement member having a trigger surface for engaging the trigger upon the high voltage folding disconnect switch closing which releases the lock of the folding switch blade;

the locking bar having a cam slot therethrough in operative position adjacent the trigger, the cam slot having a cam surface of predetermined configuration to cause a locking action to maintain the switch blade folded and an unlocking action to permit straightening of the folding switch blade; and, a cam follower pin which slides in the cam slot attached to the folding blade portion in operative engagement with the cam slot, whereby the switch blade is maintained locked from folding straight until the lock is released by the cam follower pin sliding to about the middle of the slot, to permit the switch blade to straighten to allow the folding switch blade to engage the break jaw contact in the fully electrically closed position of the switch.

2. The high voltage folding disconnect switch of claim 1, wherein the locking bar has a central elongated offset section offset a predetermined distance from a center line 'L' of the switch blade in the closed position.

3. The high voltage folding disconnect switch of claim 1, wherein the cam slot has a reverse "S" shape.

4. The high voltage folding disconnect switch of claim 1, wherein the high voltage folding disconnect switch is a side break switch or a folding grounding blade switch or a folding double break switch.

5. The high voltage folding disconnect switch of claim 1, wherein the cam slot has a first section in operative arrangement with the cam follower pin for preventing the switch blade from straightening and a second section for permitting the switch blade to straighten.

6. The high voltage folding disconnect switch of claim 1, wherein the trigger member moves along the trigger surface as the cam follower pin moves from the first section of the slot to the second section of the slot to cause the locking function of the folding switch blade to unlock, to allow the folding switch blade to straighten and allow the blade contact to fully mate with the jaw contacted.

7. The high voltage folding disconnect switch of claim 1, further comprising a break jaw contact pin including a contact spring operatively attached to a distal end of the folding blade portion, the break jaw contact pin with the contact spring for operative electrical engagement with the break jaw contact upon the closing of the high voltage folding disconnect switch.

* * * * *